US007744436B2

(12) United States Patent
Pole, III et al.

(10) Patent No.: US 7,744,436 B2
(45) Date of Patent: Jun. 29, 2010

(54) RESCUE MAT

(75) Inventors: Robert C. Pole, III, Glen Ellyn, IL (US); Mark Ball, Great Bend, KS (US); Charles G. Detmar, Jr., Three Rivers, MI (US); Jay Crookston, Glen Ellyn, IL (US)

(73) Assignee: BRK Brands, Inc., Aurora, IL (US)

( * ) Notice: Subject to any disclaimer, the term of this patent is extended or adjusted under 35 U.S.C. 154(b) by 0 days.

(21) Appl. No.: 12/273,314

(22) Filed: Nov. 18, 2008

(65) Prior Publication Data

US 2009/0186540 A1 Jul. 23, 2009

Related U.S. Application Data

(63) Continuation-in-part of application No. 11/001,661, filed on Dec. 1, 2004, now abandoned.

(51) Int. Cl.
*B63C 9/32* (2006.01)

(52) U.S. Cl. ..... 441/82; 441/129

(58) Field of Classification Search ..... 441/129–131, 441/80, 82

See application file for complete search history.

(56) References Cited

U.S. PATENT DOCUMENTS

| | | | |
|---|---|---|---|
| 19,593 | A | 3/1858 | Urouhart |
| 67,039 | A | 7/1867 | Golding |
| 1,829,137 | A | 10/1931 | Harris |
| 2,850,252 | A | 9/1958 | Ford |
| 3,016,317 | A | 1/1962 | Brunner |
| 3,034,155 | A | 5/1962 | Freeland |
| 3,237,414 | A | 3/1966 | Straub et al. |
| 3,284,819 | A | 11/1966 | Nissen |
| 3,380,088 | A | 4/1968 | D'Adesky |
| 3,428,974 | A | 2/1969 | Stuart |
| 4,147,828 | A | 4/1979 | Heckel et al. |
| D259,497 | S | 6/1981 | Mahler |
| 4,275,473 | A | 6/1981 | Poirier |
| 4,365,914 | A | 12/1982 | Sluys |
| 4,451,240 | A | 5/1984 | Wood |
| 4,459,714 | A | 7/1984 | Lin |
| 4,662,851 | A | 5/1987 | Foster |
| 4,673,184 | A | 6/1987 | Sansores |
| 4,822,309 | A | 4/1989 | Vandenberg |
| 5,027,613 | A | 7/1991 | Pare |
| 5,129,347 | A | 7/1992 | Hill |
| 5,536,009 | A | 7/1996 | Edwards |
| 5,772,535 | A | 6/1998 | Murphy |

(Continued)

OTHER PUBLICATIONS

A gym mat has been used in the water at Corey Lake in Michigan beginning in the summer of 2002.

(Continued)

*Primary Examiner*—Edwin Swinehart
(74) *Attorney, Agent, or Firm*—Lawrence J. Shurupoff

(57) ABSTRACT

A portable, roll-able or fold-able mat for supporting one or more individuals includes a non-inflatable, buoyant core. The core includes buoyancy sufficient to support the one or more individuals on a surface of the mat. The core includes at least one layer of foam and a non-foam layer connected with at least one surface of the layer of foam.

1 Claim, 7 Drawing Sheets

U.S. PATENT DOCUMENTS

| | | | | |
|---|---|---|---|---|
| 5,779,513 | A * | 7/1998 | Burton et al. | 441/129 |
| 5,810,632 | A | 9/1998 | Hutson, III | |
| 5,839,976 | A | 11/1998 | Darr | |
| 5,916,034 | A | 6/1999 | Lancia | |
| 6,004,219 | A | 12/1999 | Peabody | |
| 6,171,160 | B1 | 1/2001 | Skaggs et al. | |
| 6,223,673 | B1 | 5/2001 | Mears et al. | |
| 6,604,719 | B1 * | 8/2003 | Dicke et al. | 248/160 |
| 6,805,066 | B2 | 10/2004 | Johnson | |
| 2004/0028478 | A1 | 2/2004 | Lekhtman | |

OTHER PUBLICATIONS

Overton's Catalog, cover page and pp. 157-158, catalog expired Dec. 31, 2003.

* cited by examiner

RESCUE MAT

CROSS REFERENCE TO RELATED APPLICATIONS

This application is a continuation in part of U.S. patent application Ser. No. 11/001,661, filed Dec. 1, 2004 now abandoned.

BACKGROUND

Every year there are numerous occurrences of people or animals trying to cross a frozen river or pond and falling through the ice into the water below. Because hypothermia develops very quickly, there is a need to rescue individuals without delay. Additionally, there are numerous occurrences of people or animals getting stuck in swamps, mud created by flooding, and other similar situations. In each of these situations, rescuers have limited time to bring the people or animals to safety and they often imperil their own safety in an attempt to rescue the distressed victim.

BRIEF SUMMARY

A portable, roll-able or fold-able mat for supporting one or more individuals includes a non-inflatable, buoyant core. The core includes buoyancy sufficient to support the one or more individuals on a surface of the mat. The core includes at least one layer of foam and a non-foam layer connected with at least one surface of the layer of foam.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

DETAILED DESCRIPTION

The present disclosure relates to a floating mat that may be used to rescue people or animals from unstable surfaces, such as after falling through ice. It may also be used to assist rescues in swamp or flood environments where it is too dry to use watercraft and too wet for individual human rescue. The floating mat may be rolled out on ice or swamp mud by a rescuer in seconds to aid pulling the victim to safety. Other embodiments of the mat may be used recreationally.

The floating mat is stable and buoyant and therefore rescuers may be able to conduct rescue procedures on the victim while still on the ice or swamp. Due to its strength and durability, a rescuer can pull the mat off of the ice or out of the swamp while rescuers and victims are still on it. The mat may also be lightweight and flexible enough to be roll-able or fold-able and portable.

Other rescue techniques, such as throwing a rope to the victim and pulling them to safety, rely on the ability and strength of the victim to hold the rope. Use of the floating mat may require little if any physical exertion by the victim. Also common is for rescuers to attempt to approach the victim. The floating mat may allow the rescuer to approach the victim safely with minimal risk of personal harm. Common rescue techniques, such as the use of rafts or roping equipment, may require set up and maintenance time. The mat can be deployed quickly and may require little maintenance.

Figure 1:
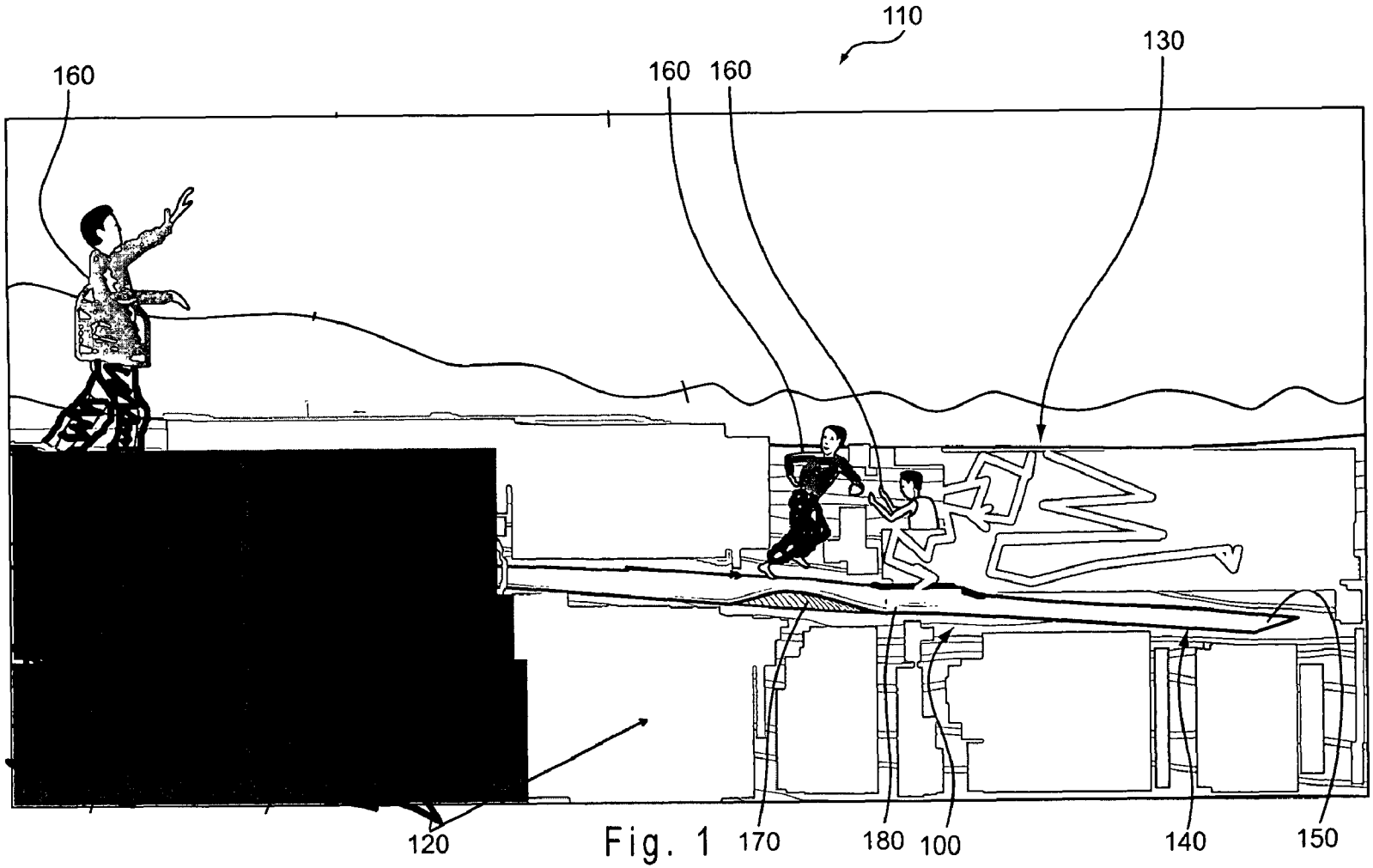
FIG. 1 is a diagram of a mat in a rescue environment.

FIG. 1 is a diagram of a mat 100 in a rescue environment 110. The rescue environment 110 may include a body of water 120 such as a frozen lake. The mat 100 may also be used on land rescue environments 130, for example, a swamp or flooded land. The mat 100 includes a buoyant core 170. The core 170 may be constructed from one or more foam layers, e.g., a polyolefin or polyethylene foam layer. The core 170 may include other materials such as polyurethane. The core 170 is preferably non-inflatable, but in other implementations may be inflatable or partially inflatable. A thickness of the core 170 may be about a ¾ to about 3 inches. Typically, a maximum thickness per layer of foam is about ⅝ inches.

Figure 2:
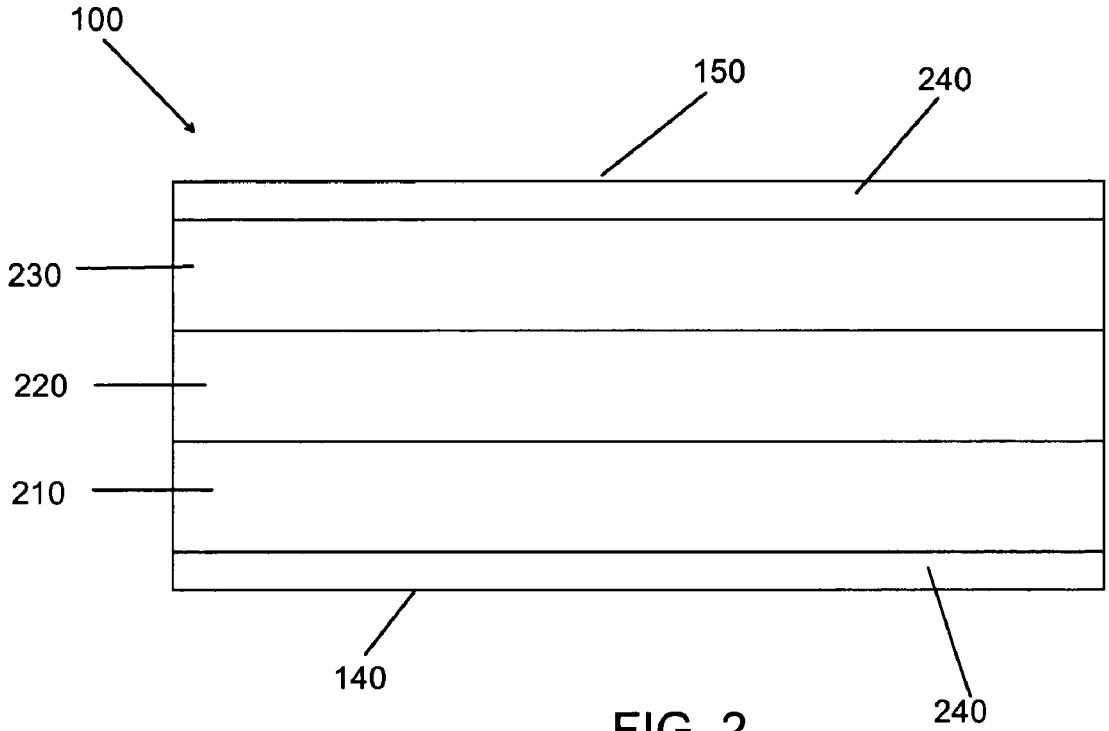
FIG. 2 is a cross-sectional view of a mat.

In FIG. 2 is a side view of the mat 100 including, for example, the core 170 of the mat 100 being constructed of three layers, a first layer 210, a second layer 220, and a third layer 230. In other implementations, the mat is constructed of more or less layers, such as one, two or four layers. Together, layers 210, 220, and 230 may form the core 170. Each layer 210, 220, and 230 may be connected together, such as with laminating. The laminating may be flame laminating. Typically the layers 210, 220, and 230 may be connected directly together, but in other implementations other layers, such as non-foam layers, may be connected between the foam layers.

Non-foam layers 240 may be connected onto one side or both sides of the assembled core 170, such as by laminating the non-foam layer to a foam layer. The foam and the non-foam may include, for example, a polyolefin material. The foam and the non-foam may further include, for example, a polyethylene. The foam may further be of ⅝ inch cross-linked polyethylene foam sheeting which may further be a chemically cross-linked two pound density material. The non-foam may be a polyolefin having an ASM tested tensile strength of, for example, 200/170 pounds when tested by the grab method. Each layer 210, 220, and 230 may have the same dimensions or the dimensions may vary between each layer 210, 220, and 230.

Figure 3:
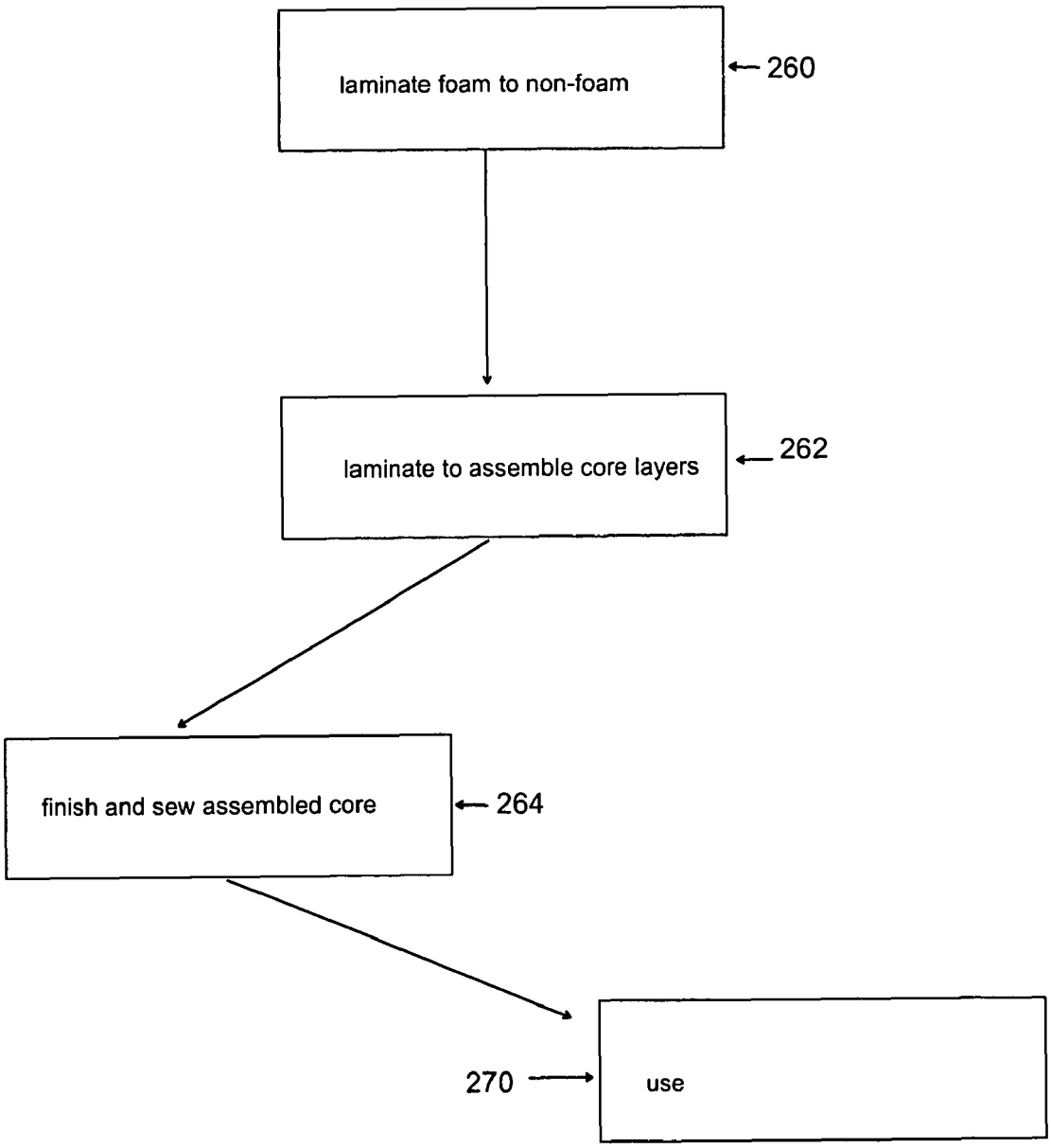
FIG. 3 is a flow chart.

The mat 100 may be manufactured as in FIG. 3. The non-foam layer 240, such as a mesh or sheeting, may include a heavy gauge woven polyolefin mesh, such as polyethylene, and may be connected to a foam layer, such as by flame laminating ⅝ inch cross-linked polyethlene foam sheeting to the non-foam layer 240. The non-foam layer 240 may be orange in color, or another color that may be easily visible such as during a rescue operation. Block 260. One or more foam layers, e.g., the first layer 210, the second 220, and the third layer 230 may be connected together, such as with flame laminating. Other numbers of layers may be used, such as two or four, or more. Block 260. When the foam layers are connected together, the non-foam layer 240 remains on an outer surface of the connected foam layers. Block 262. The non-foam layer 240 may be laminated such that, for example, approximately six inches of material hangs over each long edge. Block 262. The material hanging over the edge may be finish-folded and sewn through the layers of material with a double-needled sewing machine using heavy gauge polyester thread. Block 264. This step may seal and cover the long edges 250 of the mat 100. In addition to, or instead of, the mesh, the foam may be connected with a polyvinyl sheath which may lend durability and strength to the mat without adding significant weight. Block 268.

The non-foam layer 240 may be connected to one or both of the outer surfaces of the mat 100, but not between the layers 210, 220, 230. In other implementations, the non-foam layer 240 may also be connected between layers of the foam.

Referring again to FIG. 2, a top 150 of the mat 100 may be manufactured of the same material as the buoyant core 170 or other materials such as a polyurethane, to give a soft feel to an individual 160, who may be a victim or rescuer. A bottom 140 and the sides 180 of the mat 100 may be constructed from the same material as the buoyant core 170 and may include other materials such as a durable polyethylene material to protect the foam from being punctured. The top 150, bottom 140 and/or sides 180 may also be constructed of other material such as vinyl and/or a combination of heavy vinyl and high weave count polyester to provide for puncture and tear resistance. For example the bottom 140, top 150 and/or sides 180 may all be made of the same material; the bottom 140, top 150 and/or sides 180 may all be made of the different material, the bottom 140 and top 150 may be the same material and the sides 180 may be made of different material, the bottom 140 and side 180 may be made of the same material and the top 150 may be a different material, or the top 150 and side 180 may be made of the same material and the bottom 140 may be of a different material. At least an outer layer of the mat 100 may be weather proof, to withstand heat, cold, wind, rain and snow.

The mat 100, whether constructed of one or multiple layers, may include a total thickness of about ¾ of an inch to 6 inches or more, and more particularly may be about 2 inches thick. The mat 100 may include various shapes such as a generally rectangular shape. The mat 100 may also include other shapes such as generally circular, generally triangular, and generally elliptical, or other shapes such as a trapezoid. The mat 100 may also include an abstract shape that is not generally defined. A rectangular shaped rescue mat 100 may be about five feet wide by twenty five feet long, or other variations of the length being five times greater than the width. Other sizes may also be used. Even though the mat 100 may include multiple layers, the finished product may include a substantially uniform appearance such that there are no bend or gaps in the mat 100. Alternatively or additionally, the mat 100 may include fold lines, such the mat 100 may be folded onto itself.

A mat 100 may be rolled for storage or transportation into a roll of about 4 feet wide that is about five feet tall. It may weigh about 70 pounds wet or dry. The light weight may allow an individual 160, such as a rescuer, to deploy, position, and use the mat 100 without assistance. Alternatively, a mat 100 may be folded for storage.

Figure 4:
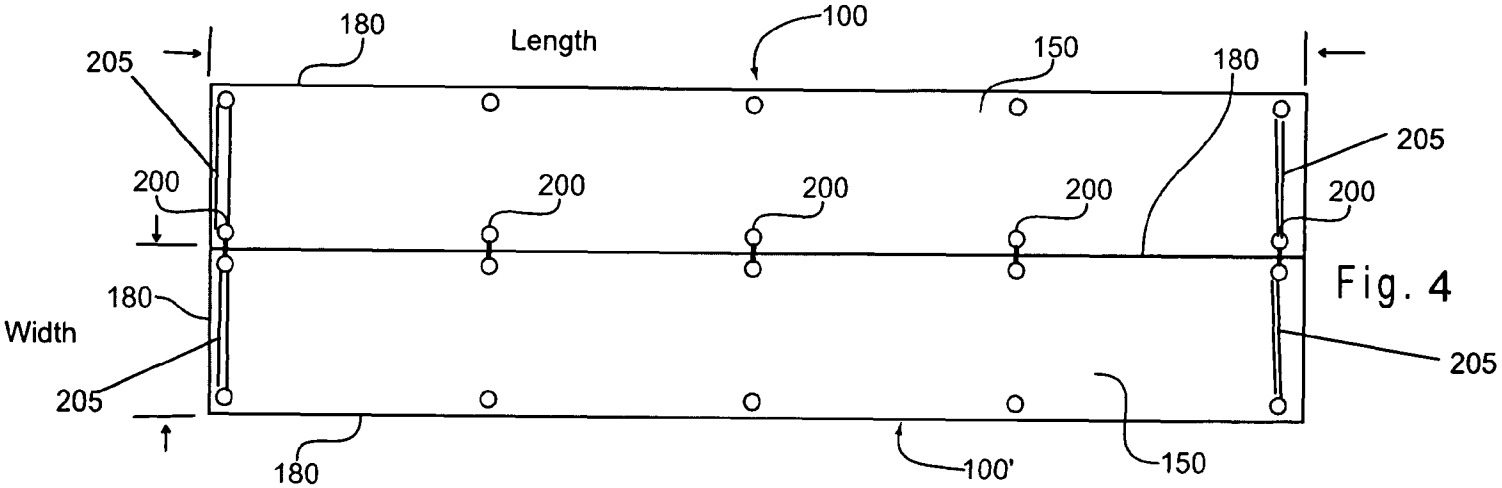
FIG. 4 is a top view of two mats connected side by side.

FIG. 4 is a top view of two mats 100 and 100' connected side by side. To accommodate the easy connection and separation of mats, the mats 100 and 100' may include a plurality of attaching mechanisms 200. Straps 205 may be connected between the attaching mechanisms 200. The straps 205 may be used by the rescuers and/or victims for holding on to the mat 100. The attaching mechanisms 200 may also be used to connect the mats 100 and 100' to other objects, such as land, a dock, rescue equipment, or ice. The attaching mechanisms 200 may also be used to secure other objects, such as by fixing one end of a rope to the attaching mechanisms 200 and the other end to ice, an anchor, a rescuer, other rescue equipment, and etc.

Figure 5:
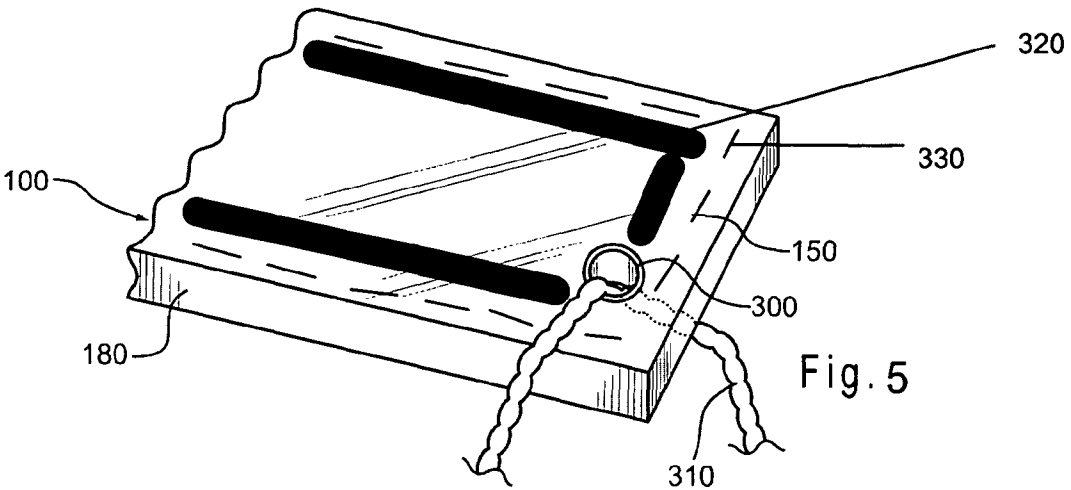
FIG. 5 is a partial diagram of the mat including an exemplary attaching mechanism.

FIG. 5 is partial diagram of the mat including a grommet hole 300, or other type of aperture, positioned through the mats 100 and 100' as an attaching mechanism. The grommet hole 300 may be positioned through the buoyant core 170. Depending on an implementation, the grommet hole 300 may be positions only at ends of the mat 100 or around the periphery of the mat 100, such as ever twelve or eighteen inches. The grommet hole 300 is positioned generally perpendicular to the ice 120 or swamp when the mat 100 is lying on the ice 120.

The grommet hole 300 may include an insert, such as a plastic insert, positioned to provide mechanical strength to help reduce wear and tear to the hole. A binding 310, such as a rope, twine, lock-tie, or other binding, can be fed through the apertures and fastened to secure the mats 100 and 100' to each other and/or another object. Rope 320 and/or stitching 330 may also be attached to the mat. For example, rope 320 may be attached to one side, to two sides, to three sides, around the entire periphery of the mats 100 and 100', or at random locations. The stitching may occur on one side, two sides, three sides, or around the entire periphery of the mats 100 and 100', or at random locations.

The attaching mechanism 200 may also include other fasteners, such as a male portion of a snap and a corresponding female portion of a snap. The snap may be integral to the mat 100 and/or attached by a tab thereto. Other attaching mechanisms 200 may also be used, such as a button and a corresponding loop hole. The attaching mechanisms 200 may also be used during storage of the mat 100, such as to maintain the mat 100 in a rolled up position, or in other ways, such as to suspend the mat 100 off the ground in to dry the mat 100. VELCRO or other fasteners may be used in conjunction with the attaching mechanisms 200 to secure the mat 100. The attaching mechanisms 200 may also be used with stakes to anchor the mat 100 to the ground.

When unrolled or unfolded, the mats 100 and 100' may be used as a floating rescue platform on which to approach and rescue a victim of an ice break or swamp. Since the mats 100 and 100' may be less than about 2 inches thick, the tops 150 of the mats 100 and 100' are located near the surface of the body of water or ice 120 and do not require a ladder or agility to mount. The mats 100 and 100' may be easily accessed by individuals 160, such as rescuers or victims. The mats 100 and 100' may be rolled up or folded for convenient moving and storage and may be easily placed in and taken out of the water by one individual 160. The mats 100 and 100' may also be used on the water 120 in a rolled up or folded position, and multiple mats 100 and 100' may be stacked one on top of another.

During a rescue, an individual 160 such as a rescuer might use a mat 100 to rescue another individual 160 as follows. If the victim has fallen through ice or into mud, the rescuer might approach a safe distance of the victim, for example, a distance at which the rescuer is still on land or standing safely on ice or swamp land. If the rescuer is within about the length of the mat 100 from the victim, the rescuer may roll out a mat 100 to the victim's location. If the distance between the rescuer and the victim is greater than the length of the mat, the rescuer may extend the size of the mat 100 by adding an additional mat 100', such as discussed below, or by overlapping ends of the mats without otherwise attaching them. The rescuer may then walk or crawl across the mat 100 to the victim's location and pull the victim to safety.

Figure 6:
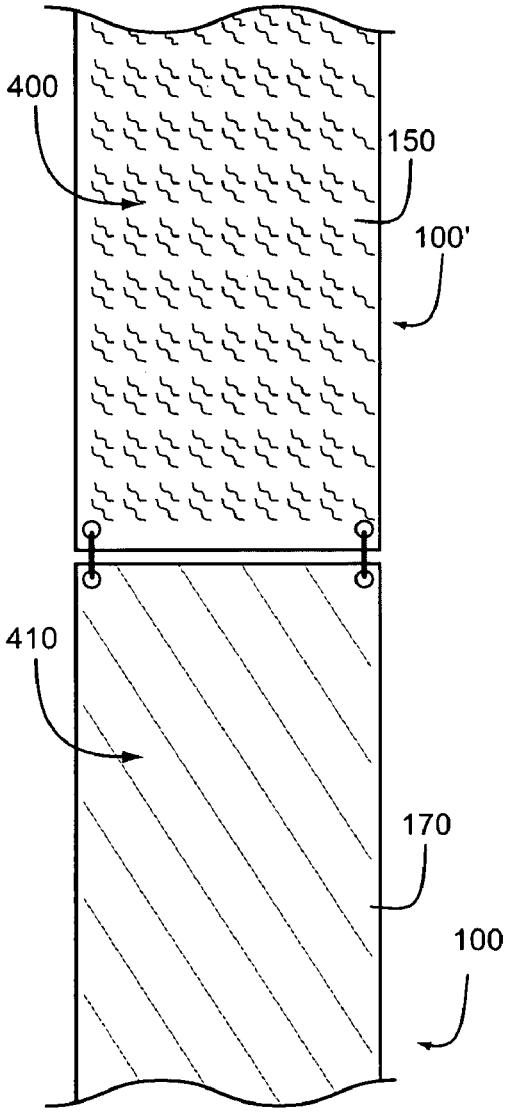
FIG. 6 is a diagram illustrating two mats connected end to end.

In FIG. 6, the mats 100 and 100' may also be connected end to end. The top 150 and/or bottom 140 of the mats 100 and

100' may be connected with a friction or frictionless surface. The friction surface may include a slip resistant 400 fastened to the mat 100, such as to provide a slip resistant running surface for the individual 160. In addition, or alternatively, the mat 100 may include a frictionless surface 410, for easily sliding the mat 100 along a surface and/or sliding objects on the mat 100.

Figure 7:
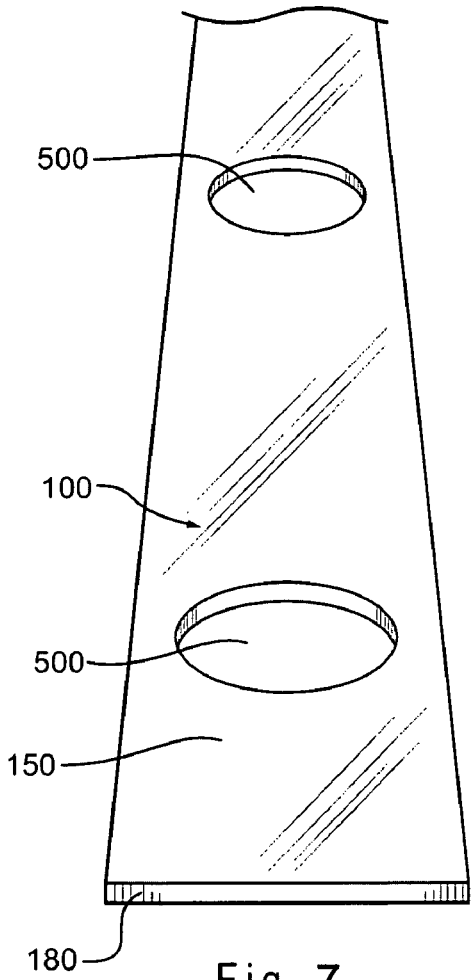
FIG. 7 is a diagram of the mat including one or more rescue holes.

FIG. 7 is a diagram of the mat 100 including one or more rescue holes 500. The rescue hole may include an aperture positioned through the mat 100 and sized such that an individual 160, such as a victim or rescuer can fit through it. The rescue holes 500 allow an individual 160, such as a rescuer to pull an individual 160, such as a victim, up through the mat 100.

Figure 8:
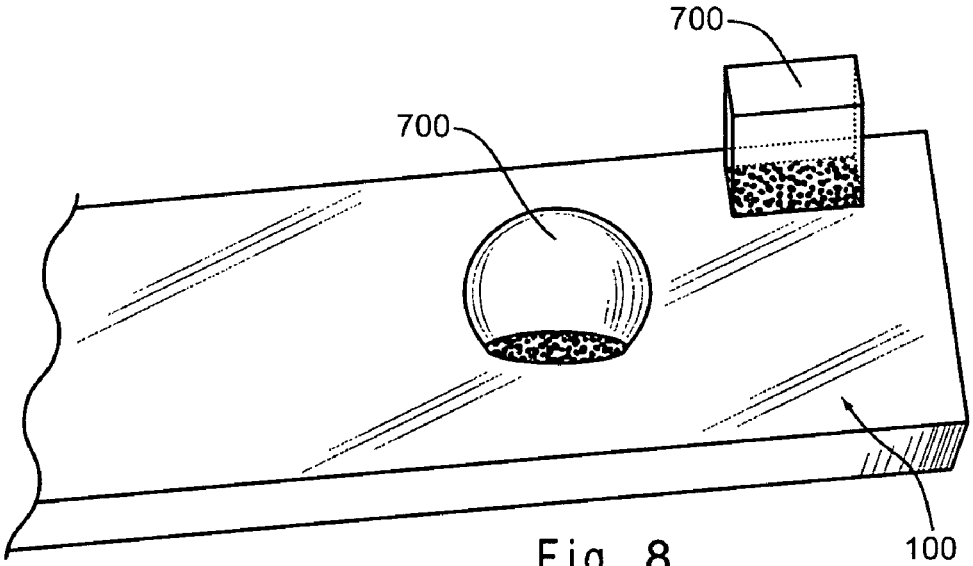
FIG. 8 is a diagram illustrating objects held to the mat.

FIG. 8 is a diagram illustrating objects 700 held to the mat 100. The objects 700 may include a piece of fabric with small hooks, such as is used with VELCRO, on at least one side to hold the object to the carpet 400. The objects 700 may be rescue equipment such as flash lights or CPR equipment or other items.

The mat 100 may include no sharp edges or hard surfaces, such as wood or metal that could injure the individual 160. No ladders are needed which may minimize the risk of injury to the victim. If no wood or metal is used, the mat 100 may require no maintenance, such as repairing rotting wood or rusted metal. Since the mat may be non-inflatable, no punctures need be repaired.

The mat 100 may not require any assembly or inflation and may be deployed with ease. The mat 100 may be deployed in seconds, allowing a rescuer to reach a victim quickly and with very little risk of personal injury. The mat 100 may be placed directly on the surface of the ice or swamp, allowing the victim to be pulled onto the mat 100 with relative ease.

A mat that is five feet wide by twenty five feet long and about 2 inches thick, may hold over 1,500 pounds of weight on open water. One or more victims may be rescued at once.

Figure 9:
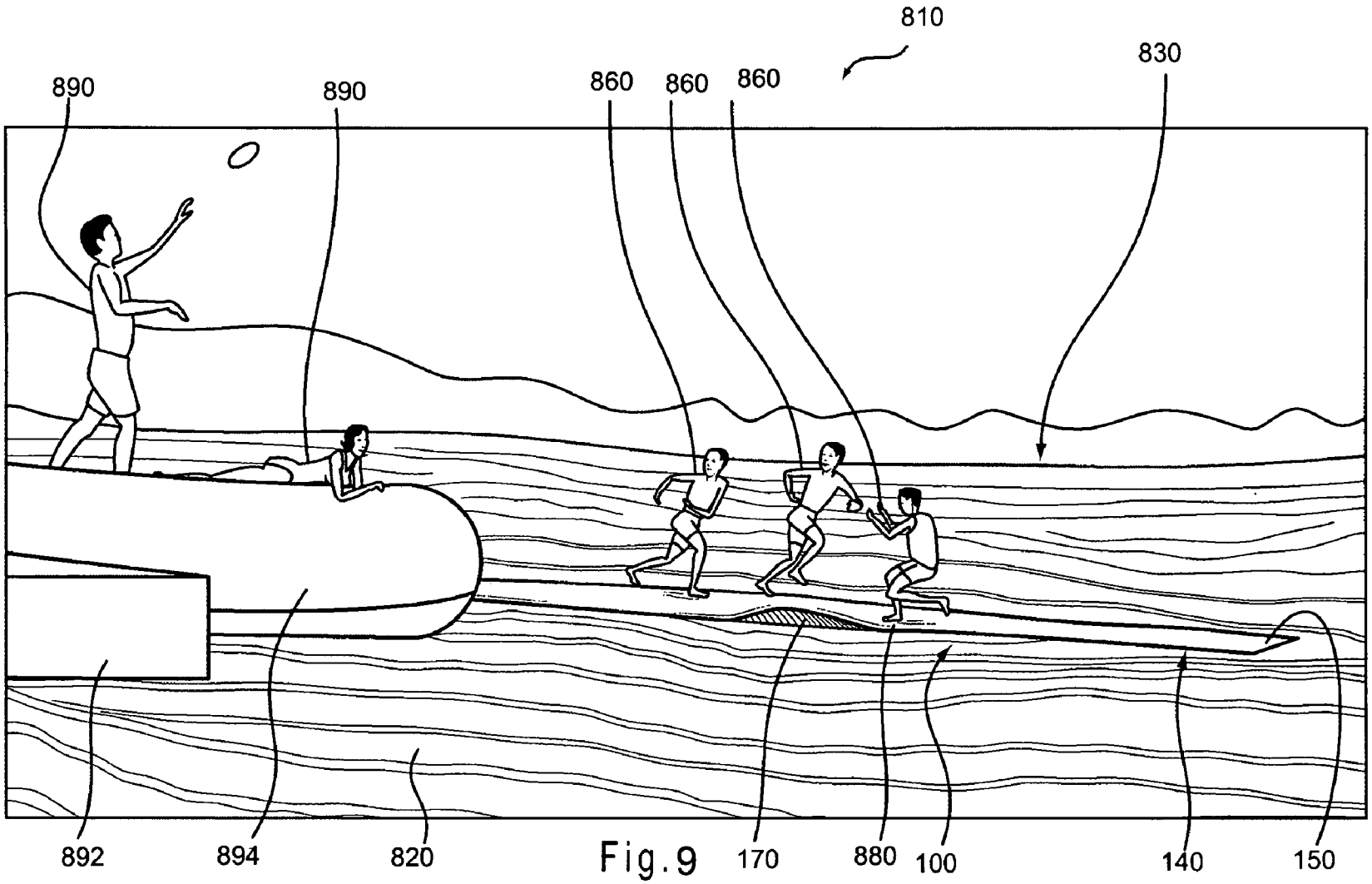
FIG. 9 is a diagram of a mat in a play environment.

FIG. 9 is a diagram of a mat 100 in a playing environment 810 as an alternative embodiment. The playing environment 810 may include a body of water 820 such as a lake. The mat 100 may also be used on land 830, for example, as a water slide or gymnastic mat. The mat 100 includes a buoyant core 170. The buoyant core 170 may include a floatable foam, such as a polyurethane foam. The buoyant core 170 may include other materials such as polyethylene. The buoyant core 170 may be constructed as described above. The buoyant core 170 is non-inflatable. A thickness of the buoyant core 170 includes about a ¾ to about 2 inches.

The mat 100 may be constructed of one layer or multiple layers. A top 150 of the mat 100 may by manufactured of the same material as the buoyant core 170 or other materials such as a polyurethane, to give a soft feel to an individual 160. A bottom 140 and the sides 180 of the mat 100 may be constructed from the same material as the buoyant core 170 and may include other materials such as a durable polyethylene material to protect the foam from being punctured. The top 150, bottom 140 and/or sides 180 may also be constructed of other material such as vinyl and/or a combination of heavy vinyl and high weave count polyester to provide for puncture and tear resistance. At least an outer layer of the mat 100 may be weather proof, to withstand heat, cold, wind, rain and snow.

The mat 100, whether constructed of one or multiple layers, may include a total thickness of about ¾ of an inch to 2 inches, and more particularly about 1¼ inches thick. The mat 100 may include various shapes such as a generally rectangular shape. The mat 100 may also include other shapes such as generally circular, generally triangular, and generally elliptical, or other shapes such as a trapezoid. The mat 100 may also include an abstract shape that is not generally defined. A rectangular shaped mat 100 may be about six feet wide by eighteen feet long. Other sizes may also be used. Even though the mat 100 may include multiple layers, the finished product may include a substantially uniform structure such that there are no bend or gaps in the mat 100.

The playing environment 810 may also include other individuals 890 that can interact with and/or observe the individuals 860 of the mat 100. The other individuals 890 may be located near the mat 100 such as on a dock 892, inflatable water raft 894 or another mat 100. The individuals 860 and 890 may include individuals of all ages and sizes.

Another embodiment may include a safety station for a life guard to monitor the playing environment 810. The safety station may be a super dense, closed-cell foam platform designed to support a lifeguard in a chair. The dimensions may be about 3.5 feet by 6.5 feet, and it may be about 6 inches thick.

While various embodiments of the invention have been described, it will be apparent to those of ordinary skill in the art that many more embodiments and implementations are possible that are within the scope of the invention.

We claim:

1. A portable, rollable, generally rectangular mat for supporting one or more individuals, comprising:

a non-inflatable, buoyant core having a first surface and an opposed second surface, said core comprising three layers of polyolefin foam bonded together with flame laminations to achieve a core thickness of about two inches, said core having a length of about 25 feet and a width of about 5 feet;

a first woven polyethylene material flame bonded to said first surface of said core;

a second woven polyethylene material flame bonded to said second surface of said core;

said first and second woven polyethylene materials extending beyond said core along said length of said core;

said first and second woven polyethylene materials interconnected with sewing so as to form a sheath around said core: and a strap provided on one longitudinal end portion of said mat for an individual to hold on to said mat, said strap extending transverse to said length of said core.

* * * * *